US006527462B2

(12) United States Patent
Arledge et al.

(10) Patent No.: US 6,527,462 B2
(45) Date of Patent: Mar. 4, 2003

(54) DEVICE FOR DATING NOTES

(75) Inventors: Arthur L. Arledge, Basking Ridge, NJ (US); James A. Austrian, New York, NY (US)

(73) Assignee: Brinwaves, Inc., New York, NY (US)

( * ) Notice: Subject to any disclaimer, the term of this patent is extended or adjusted under 35 U.S.C. 154(b) by 0 days.

(21) Appl. No.: 09/814,449

(22) Filed: Mar. 22, 2001

(65) Prior Publication Data

US 2002/0136581 A1 Sep. 26, 2002

(51) Int. Cl.[7] ..... B41J 5/00
(52) U.S. Cl. ..... 400/103; 400/104
(58) Field of Search ..... 400/103, 104

(56) References Cited

U.S. PATENT DOCUMENTS

| | | | | | |
|---|---|---|---|---|---|
| 3,725,947 | A | * | 4/1973 | Albertini et al. | 200/DIG. 2 |
| 4,170,015 | A | | 10/1979 | Elliano et al. | 346/76 |
| 4,227,199 | A | | 10/1980 | Sharkey | 346/1.1 |
| 4,283,769 | A | * | 8/1981 | Asada | 346/20 |
| 4,358,777 | A | | 11/1982 | Bille | 346/82 |
| 4,377,111 | A | | 3/1983 | Kincheloe et al. | 101/44 |
| 4,388,629 | A | * | 6/1983 | Shibata | 346/81 |
| 4,421,428 | A | | 12/1983 | Noda et al. | 400/120 |
| 4,542,286 | A | | 9/1985 | Golarz | 235/377 |
| 4,831,388 | A | | 5/1989 | Yamanaka | 346/95 |
| 4,899,173 | A | | 2/1990 | Elliano | 346/82 |
| 5,110,787 | A | * | 5/1992 | Yukita et al. | 428/41.6 |
| 5,149,613 | A | | 9/1992 | Stahlhofen et al. | 430/296 |
| 5,195,832 | A | | 3/1993 | Fujikawa et al. | 400/120 |
| 5,350,199 | A | * | 9/1994 | Young et al. | 283/91 |
| 5,519,507 | A | | 5/1996 | Subramaniam et al. | 358/402 |
| 5,557,721 | A | | 9/1996 | Fite et al. | 395/148 |
| 5,761,996 | A | | 6/1998 | Gauthier et al. | 101/93 |
| 5,764,250 | A | | 6/1998 | Tenenbaum et al. | 346/80 |
| 5,848,401 | A | | 12/1998 | Goldberg et al. | 705/408 |
| 5,989,382 | A | | 11/1999 | Parker | 156/292 |

FOREIGN PATENT DOCUMENTS

| | | | | |
|---|---|---|---|---|
| EP | 2272082 | A1 * | 5/1994 | G04G/1/00 |

* cited by examiner

*Primary Examiner*—Andrew H. Hirshfeld
*Assistant Examiner*—Charles H. Nolan, Jr.
(74) *Attorney, Agent, or Firm*—Darby & Darby

(57) ABSTRACT

A device for placing the time and date on notepaper comprises a container, a tray within the container for holding a pad of notepaper, and means for biasing the tray upwardly. The device includes a thermal print head attached to the bottom surface of a cover for the container for printing a time and date stamp on a single sheet of paper in response to the user's removal of the sheet from the container.

19 Claims, 5 Drawing Sheets

DEVICE FOR DATING NOTES

FIELD OF THE INVENTION

This invention relates to a device which automatically stamps a date (and time) on a piece of notepaper on which hand written notes are taken.

BACKGROUND OF THE INVENTION

People make hand written notes for many purposes. For example, in the course of a telephone conversation, it is common to jot down the notes reflecting the substance of the conversation. It is very often necessary to refer back to notes and in many cases the date on which the note was taken is significant. Sometimes, the time at which the note is written is also meaningful. If the notetaker fails to indicate in hand the date and time this critical information can be lost, sometimes irretrievably.

The present invention provides a device which holds a pad of notepaper and which automatically stamps the date (and time) on each piece of paper as it is removed from the device. In effect, the user's hand-written notes are automatically date stamped.

SUMMARY OF THE INVENTION

In accordance with the invention, a pad of note paper is contained within a device which includes a mechanism for keeping track of the date and time, and a printing mechanism which can be actuated to print date and time information received from the clocking mechanism. The device which contains the paper includes a means which is responsive to the removal of an individual sheet of paper from the device for actuating the printing mechanism. Thus, each piece of paper removed from the pad is stamped with the date on which it was used.

In the preferred embodiment, a thermal printer is used and the paper includes a special thermally responsive ink in a location corresponding to the printer location. Printing takes place sequentially as the paper is manually removed from the device.

DETAILED DESCRIPTION

It is contemplated that the date and time will be printed on each piece of notepaper as it is removed from the container but it may also be desirable to print only the date on which the paper was removed. As used herein, the term "time information" is intended to refer to information which reflects either a date or time or both.

Figure 1:
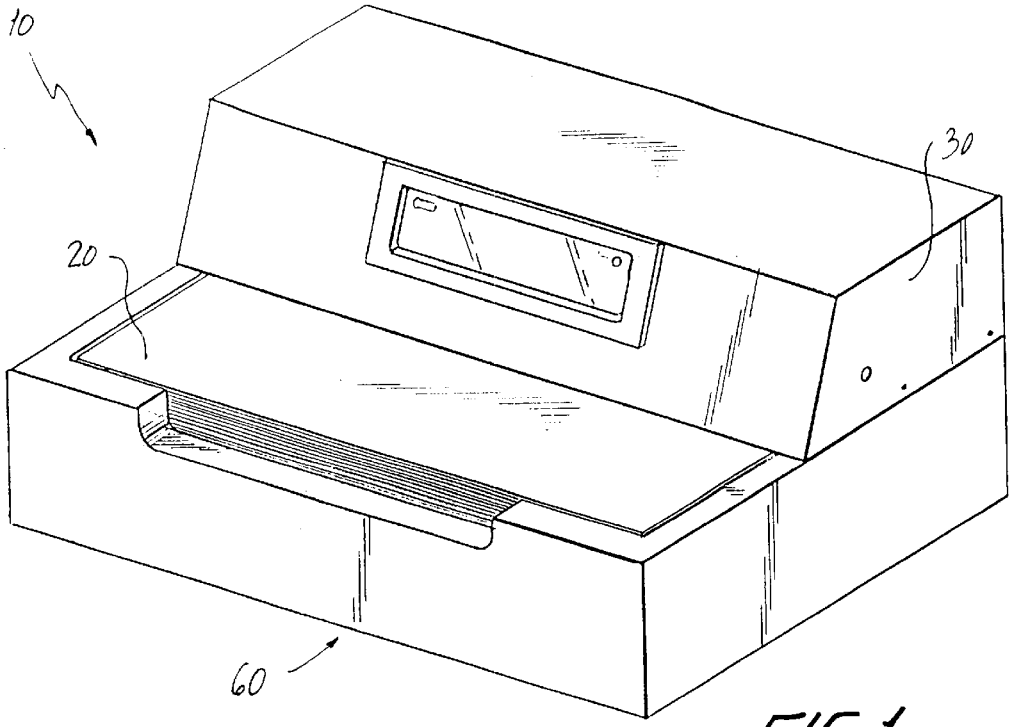
FIG. 1 is a perspective view of a preferred embodiment of the invention.
Figure 2:
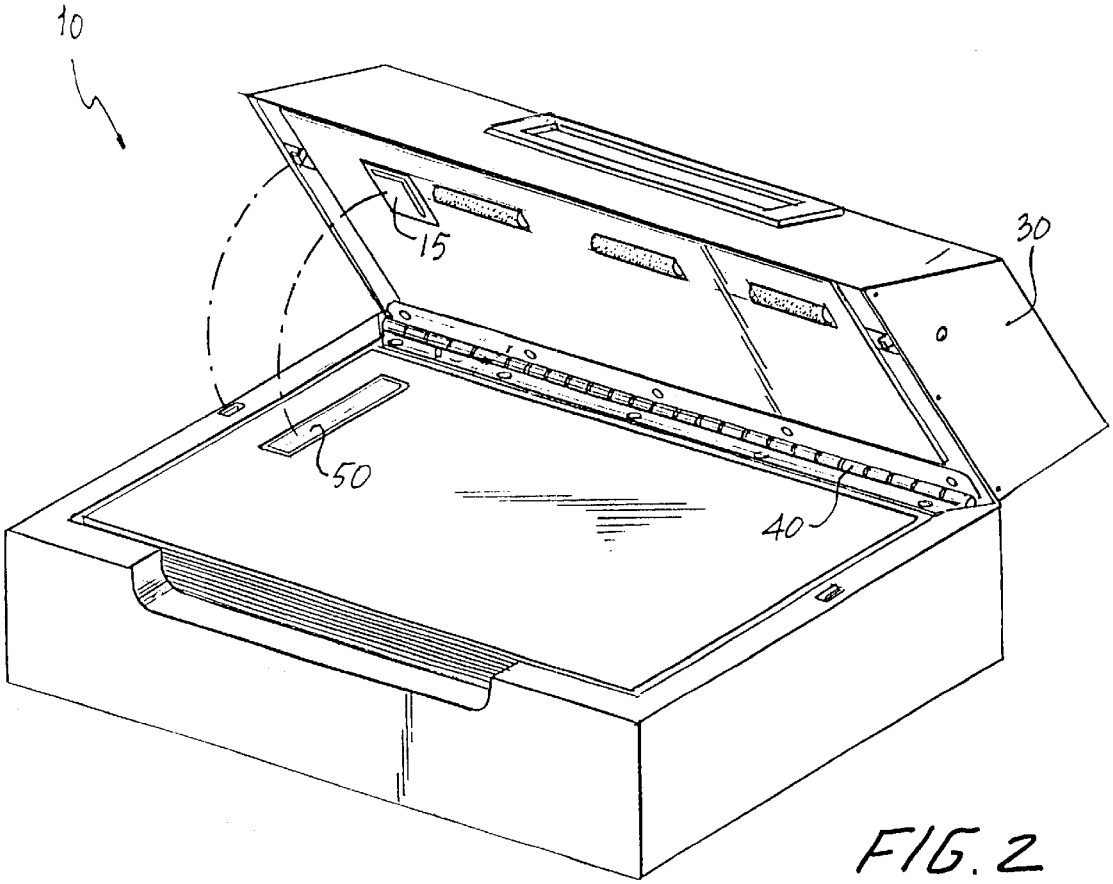
FIG. 2 is a perspective view of the preferred embodiment with the cover open.

Turning now to FIGS. 1 and 2, the invention comprises a container 10 equipped with a print head 15 for printing the time and date on notepaper 20 when a user removes a piece of notepaper 20 from the container 10. The notepaper is provided in the form of a pad or stack so that the top sheet can be easily slid from the pad. The container 10 has a hinged top for allowing a user to store the pad of notepaper 20 within the container 10. The container 10 includes a cover 30 connected to the rear of the container 10 by a conventional hinge 40. The hinge 40 allows the cover 30 to rotate between zero degrees (closed) and one hundred and eighty degrees (open).

The shape of the notepaper 20 is preferably rectangular and the size of the notepaper 20 may be, for example, four and a half inches by six and a half inches. The notepaper 20 includes a clear coating of a heat sensitive ink 50 which changes color irreversibly when heated past a threshold temperature by the thermal print head 15. A water based lacquer covers the ink 50 to protect the ink during subsequent processing. The ink 50 is located in the area where the print head 15 meets the notepaper 20 when the cover 30 is closed.

Figure 3:
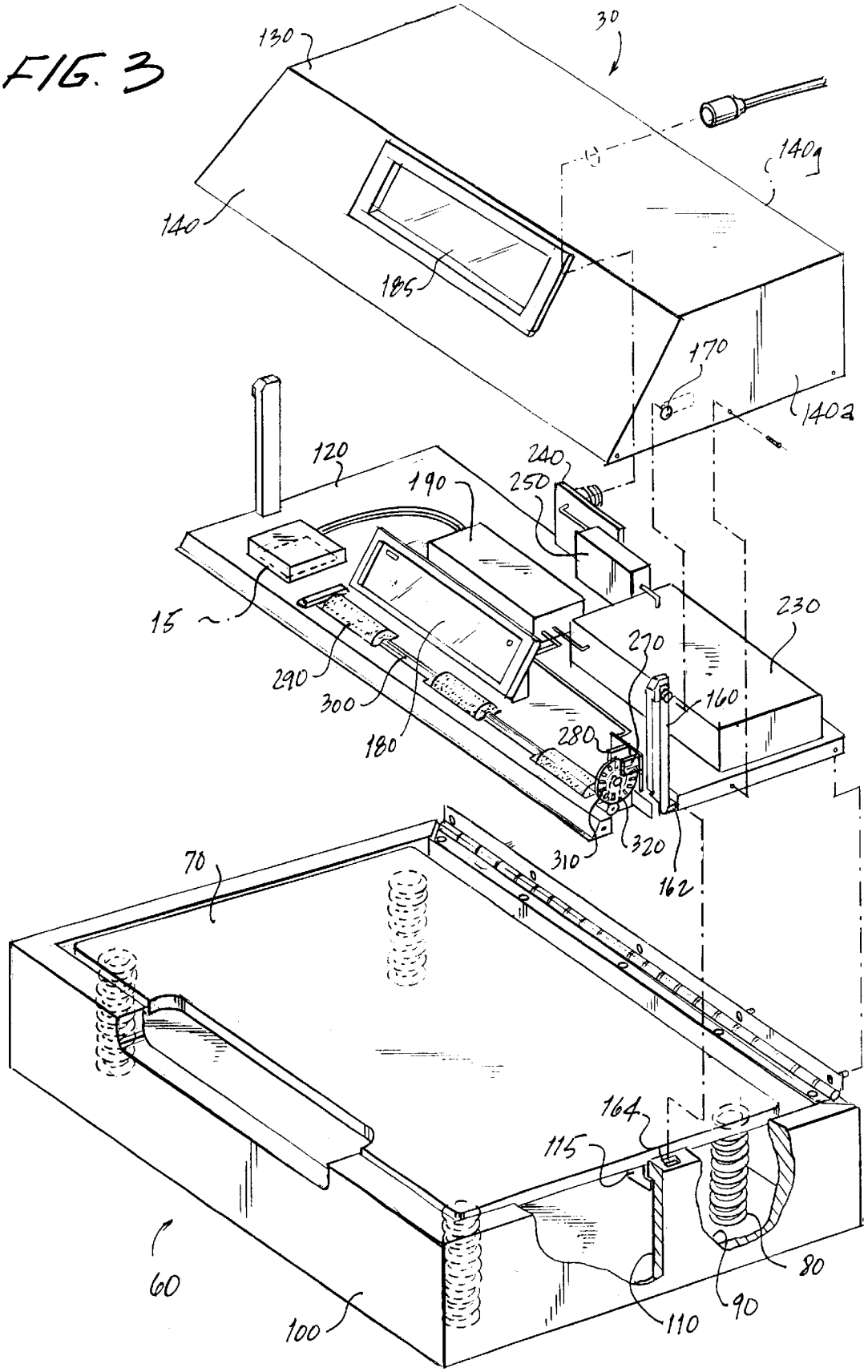
FIG. 3 is an exploded perspective view of the preferred embodiment of the invention.
Figure 4:
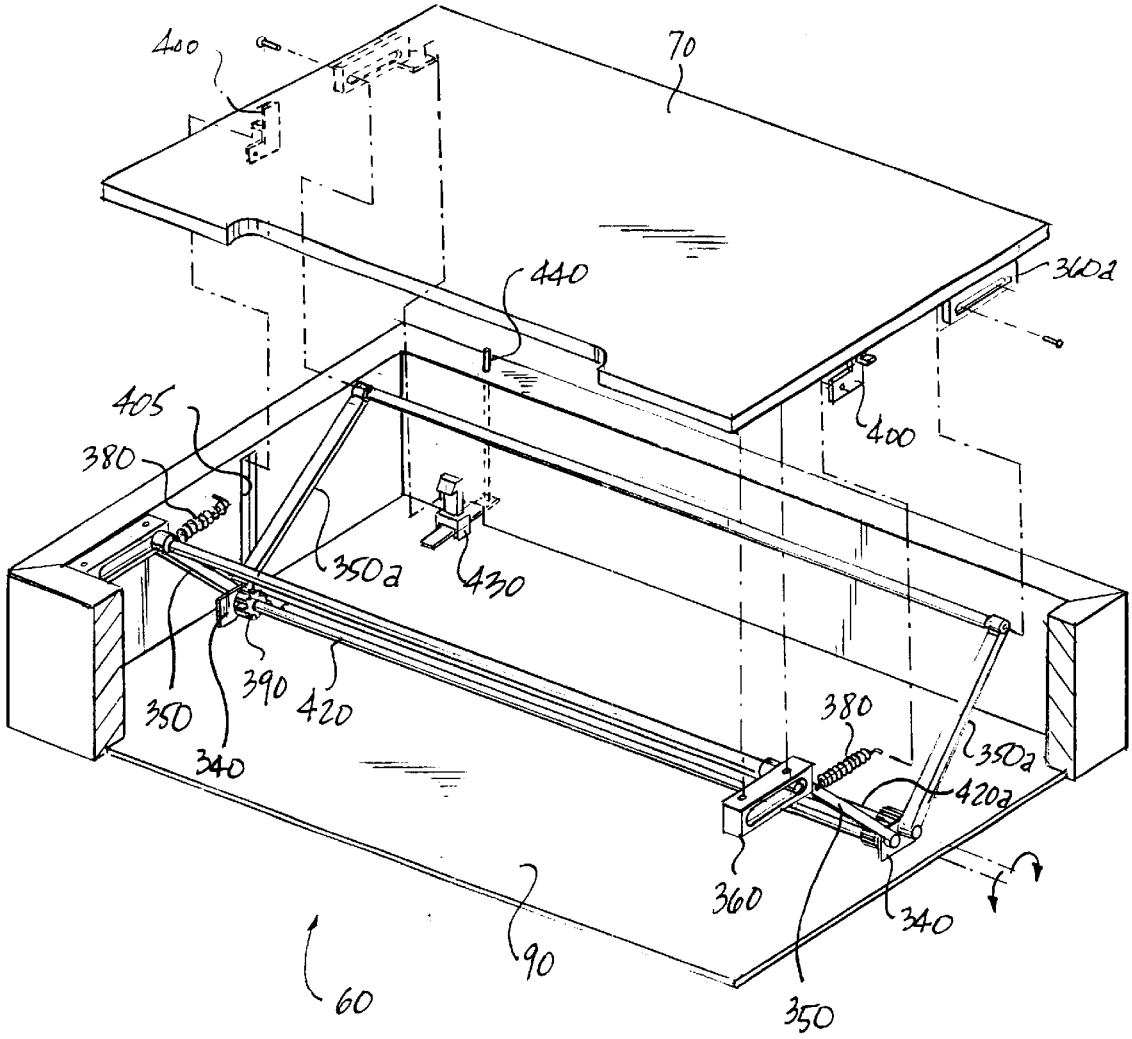
FIG. 4 is a perspective view of an alternative mechanism for actuating the paper tray lifting means.
Figure 5:
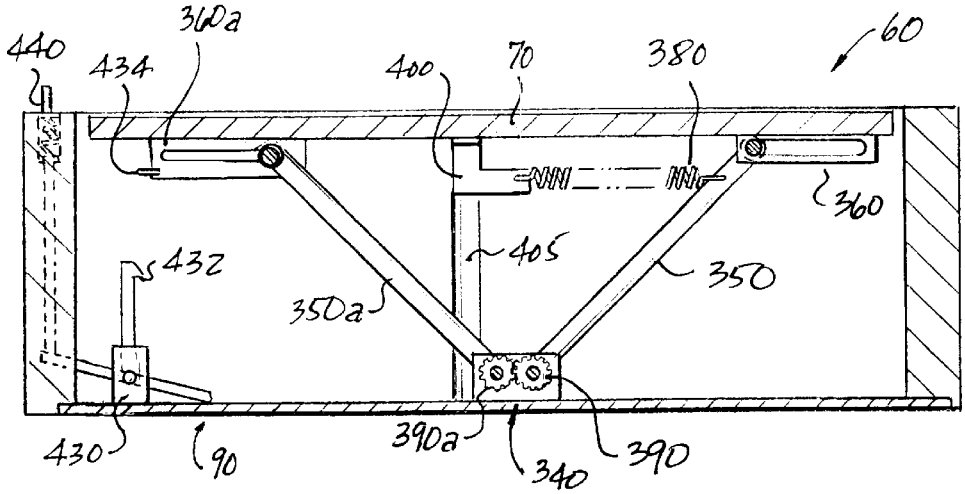
FIG. 5 is a side sectional view of the mechanism shown in FIG. 4 with the supporting tray in its uppermost position.

As seen in FIG. 3, the container 10 comprises a bottom section that includes a shell 60, a notepaper holding tray 70, and four coil springs 80 for biasing the tray 70 upwardly against print head 15. The shell 60 consists of a bottom plate 90 and four side walls 100. Each side wall 100 includes a vertical groove 110 which mechanically cooperates with a vertical guide 115 (discussed below). The cover 30 comprises a bottom plate 120, a top plate 130, and four side walls 140. The width of the cover 30, projecting forward from the hinge 40 to the front plate 140 may, for example, be sixty percent of the width of the tray 70. The purpose of this differential is to allow for the user to easily grab the forward edge of a piece of notepaper 20 from the stack of notepaper stored on the tray 70.

The springs 80 press the tray 70 and stored notepaper 20 against the undersurface of bottom plate 120 of cover 30. In the preferred embodiment, the tray 70 includes two vertical guides 115. The vertical guides 115 are connected to opposing side edges of the tray 70 and mechanically engage the vertical grooves 110. Together, the guides 115 prevent undesirable rotating, translating or other jamming motions of the tray 70, which might result when the user presses unevenly on the tray 70 while attempting to reload the tray with notepaper 20.

The tray 70 fits within the shell 60 and is sized so that it may move vertically within the shell 60 between a top position and a bottom position as determined by the springs 80. Preferably, in the top position, the upper surface of tray 20 is slightly above the upper surfaces of side walls 100.

The cover 30 comprises two locking mechanisms 160 connected to opposing sides of the bottom plate 120 of the cover 30 for locking the cover 30 in a closed position against the shell 60. Each locking mechanism 160 includes a spring loaded hook 162 that fits into a corresponding catch 164 within the shell 60 and is engaged when the cover 30 is closed. Each locking mechanism 160 also includes a push-button 170 for disengaging the hook 162 from the catch 164. Push-buttons 170 are accessible to the user on an opposing side plate 140*a* of cover 30. When both locking mechanisms 160 are engaged, the pressure that exists between plate 120 and tray 70 prevents the stack of notepaper 20 from shifting within the container 10, yet allows for the removal of a single sheet of notepaper 20.

The overall dimensions of the container 10 are partially dependent on the size of the notepaper 20. The shell 60 must be large enough to house a stack of, for example, fifty sheets of notepaper 20. The area of the tray 70 should not be significantly larger then the notepaper 20 to ensure that the stack of notepaper 20 remains organized with the container 10 and to ensure that only one sheet of notepaper 20 is removed from the container 10 at any one time. Thus, where the notepaper 20 is approximately four and a half inches by six and a half inches, the tray 70 is also approximately four and a half inches by six and a half inches.

The cover 30 contains a clock display unit 180 for displaying the time and date, and a cutout with a window 185 located on the front plate of the cover 140 so that the user can view the display unit. The time and date display unit 180 is preferably a Liquid Crystal Display (LCD). The LCD is driven by a microprocessor 190 which keeps track of time information. Alternatively, the display unit can be a Light Emitting Diode (LED), or a gas filled display. Examples of gas filled displays include those filled with Neon or Argon.

The microprocessor 190 preferably operates in a sleep-mode for purposes of power management. While asleep, the microprocessor 190 draws one thousandth as much current as when awake. It takes about four thousandths of a second (4 ms) to transition from the sleep-mode to the awake-mode. After a second of receiving no input from the sensor 280, the microprocessor 190 transitions back to the sleep-mode. The microprocessor 190, which may be conventional, contains a crystal controlled clock generator that includes, for example, an 8.388808 MHZ crystal for "real time counting." With this generator, the clock counter is accurate to less then one second per month.

The cover 30 also contains input means (not shown), located on the back plate 140 g of the cover 30, for setting the timing information that is displayed on the display unit 180. Microprocessor 190 receives and processes the user input pertaining to the time and date, and thereafter maintains the timing information that is displayed on the display unit 180 and printed on the thermally sensitive area 50 of paper 20. The input means may comprise two buttons: one for selecting the data or time digits to be adjusted and the other for adjusting the value of selected digits. In alternative embodiments, the user can adjust the time and date directly on the display unit 180, via inputs integrated into the display unit 180. The inputs can be in the form of push buttons or capacitor sensors.

These clock arrangements are conventional. As seen in FIG. 2, the print head 15 is located so that when the notepaper 20 is placed on the tray 70, and the cover 30 is in the locked position, the print head faces the notepaper 20 at the location of the thermal (and lacquer) ink 50. In the preferred embodiment, the print head 15 is a thermal print head having a row of thermal elements (e.g. resistors) which can be heated by applying a current pulse to selected elements. A suitable print head is manufactured by Gulton Graphic Instruments (Division) of Metuchen, N.J. In the Gulton print head, each resistor element corresponds to a pixel and characters are printed by applying current pulses to selected elements. The print head may be secured in a slight recess in the bottom plate 120 of the cover 30. Since the microprocessor 190 is unable to provide the current to fully heat the print elements, an integrated circuit chip (not shown) that can provide the required current is used to interface microprocessor 190 to print head 15. In an alternative embodiment, a print head 15 comprising small transistor elements may be used to obviate the need for this integrated circuit since heating each transistor requires a small microamp control pulse from the microprocessor 190.

The cover 30 further contains means for sensing when a user removes a piece of notepaper 20 from the container 10 and communicating that information to the microprocessor 190. The sensing means comprises an infrared (IR) light source 270 and an IR sensor 280. The sensor 280 may be a conventional photo diode detector. The sensing means comprises three rollers 290 axially attached along a shaft 300, which rotate when the user removes a piece of notepaper 20, and a slotted disk 310 connected to shaft 300 by a belt 320 (shown in dotted lines in FIG. 3). The disk 310 is located between the IR source 270 and sensor 280 so that it can break the IR beam as it is rotated by the manual extraction of a sheet of notepaper 20.

The shaft 300 is rotatably mounted within bottom plate 120 of cover 30 in a pair of bearings (not shown) at either end of the shaft 300. The position of shaft 300 is such that the surfaces of the rollers 290 extend below the bottom plate, exposing the rollers 290 to the top sheet of notepaper which is upwardly biased by tray 70 so that the rollers 290 rotate in response to the removal of a piece of the notepaper 20.

The disk 310 may be connected to the rollers 290 by any standard connection which allows for a proportional rotation between the roller 290 and the disk 310, such as a set of spur gears.

The IR sensor 280 generates an on/off square wave signal as a result of the IR beam passing through the rotating disk 310. The square wave signal from sensor 280 is coupled to microprocessor 190 which responds to these signals by transitioning from a sleep-mode to an awake-mode and commanding the print head 15 to print a single column of dots. As the paper is removed, successive columns are printed until all of the desired time information appears on the paper 20 when it is fully withdrawn from the tray.

The number of signals (e.g. approximately 168) that are generated by the sensor 280 is equivalent to the number of slots within the disk 310 times the number of revolutions of disk 310 as a sheet of paper 20 is being manually extracted. Thus, for any physical configuration, the length of a printed line is controlled by the number of slots on the disk 310 and the diameter of rollers 290.

The user must not remove the notepaper 20 from the tray 70 faster than the response time of print head 15. If the user removes the notepaper 20 too quickly, causing current pulses at the print head to overlap, the micro processor 190 responds by terminating further printing and displaying an appropriate alert signal, such as "Too Fast," on the display unit 180.

The cover 30 further contains rechargeable batteries 230 for powering the device, an inlet for an AC power source 240, and conventional circuitry 250 for charging batteries 230. The batteries 230 provide power for the sensing means 280, the microprocessor 190, the display unit 180 and the print head 15. The power source 230 generates a voltage supply in the range of seven and a half to nine volts. The power source could alternatively include only an AC input.

Turning now to FIGS. 4–7, in an alternative embodiment, the tray biasing means comprises two pairs of linked beam mechanisms supporting opposite sides of the tray 70. Each linked mechanism includes forward and rearward beams 350 and 350*a*, a stationary link 340 connected to the bottom of plate 90 of shell 60, and two horizontal slide links 360 and

360*a* connected to the bottom of tray 70. Two horizontal extension springs 380 are connected between forward beams 350 and a guide posts 400 on the bottom of tray 70 to bias the tray upwardly, with the force being applied equally to the tray by the two pairs of beams 350 and 350*a*. Guide posts 400 mechanically interact with a vertical slots 405 (only one shown) in opposite walls of shell 60 to prevent movement of tray 70 in the forward or rearward direction.

Each mechanism includes two spur gears 390 and 390*a*. The forward gears 390 are rotationally located at the connection between the stationary link 340 and the forward beam 350. The rear gears 390*a* are rotationally located at the connection between the stationary link 340 and the rear beam 350*a*. The gears 390, 390*a* mesh together so that any rotation of either gear in response to vertical movement of the tray 70 forces the other gear to rotate proportionally. The advantage of the gears is that if the user vertically presses on the forward end of the tray 70, the rear end of the tray is forced to move in the same vertical direction and at the same rate. This assures the tray will not pitch forward or rearward.

A horizontal top shaft 410 supports the forward beams 350 in slide links 360 and a top shaft 410*a* support the rearward beams 350*a* in slide links 360*a*. Two horizontal bottom shafts 420 and 420*a* connect the two pairs of spur gears 390, 390*a*. The bottom shafts 420 are rigid enough to prevent a skewing motion from occurring when a user presses on only one side of the tray 70. Thus, the user can press anywhere on the tray 70 and the resulting action for the tray 70 is a smooth lowering motion.

Figure 6:
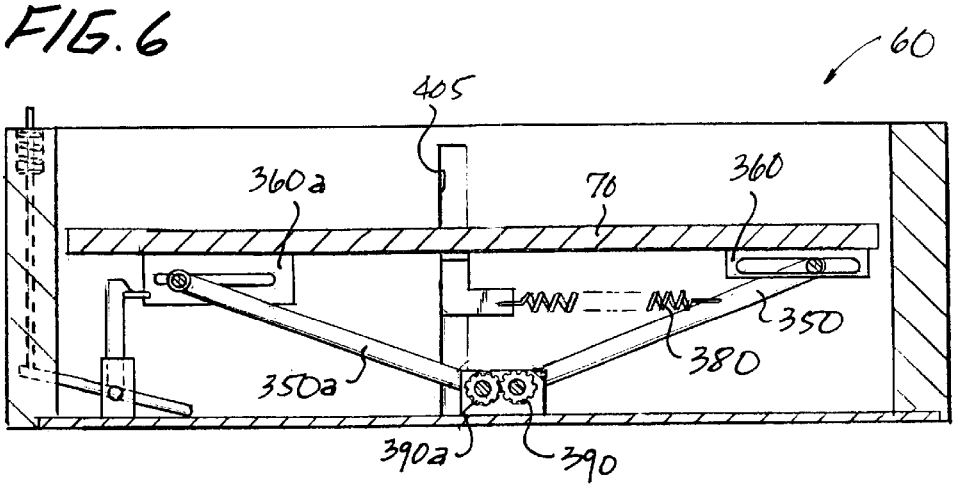
FIG. 6 is a side sectional of the mechanism shown in FIG. 4 with the paper supporting tray in its lowermost position.

The mechanism includes a spring loaded locking mechanism 430 for locking the tray 70 in its bottom position. The locking mechanism 430 is connected to the bottom plate 90 of shell 60 and includes a lip 432 which engages a rear tab 434 on slide link 360*a*. As seen in FIG. 6, the locking mechanism 430 is located in the vertical path of the rear horizontal slide 360*a* so that lip 432 engages at the lowest vertical point of slide 360*a*.

Figure 7:
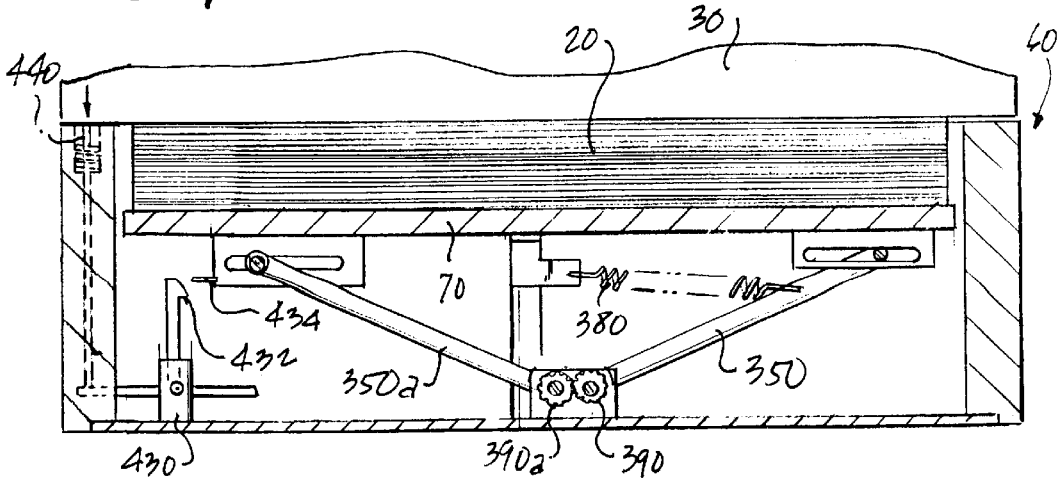
FIG. 7 is a side sectional view of the mechanism shown in FIG. 4 after it has been loaded with paper and the top replaced.

When the user seeks to reload the tray 70 with notepaper 20 with the cover 30 in the open position, the spring action in the locking mechanism 430 allows the tray 70 to be locked in the bottom position. The locking mechanism 430 is mechanically connected to a release pin 440. As seen in FIG. 7, the release pin 440 is mechanically depressed by the cover 30 so that the locking mechanism 430 is disengaged when the cover 30 is closed. Thus, when the user has filled the container 10 with notepaper 20, the user closes the cover 30 which depresses the release pin 440 and releases the tray 70.

Figure 8:
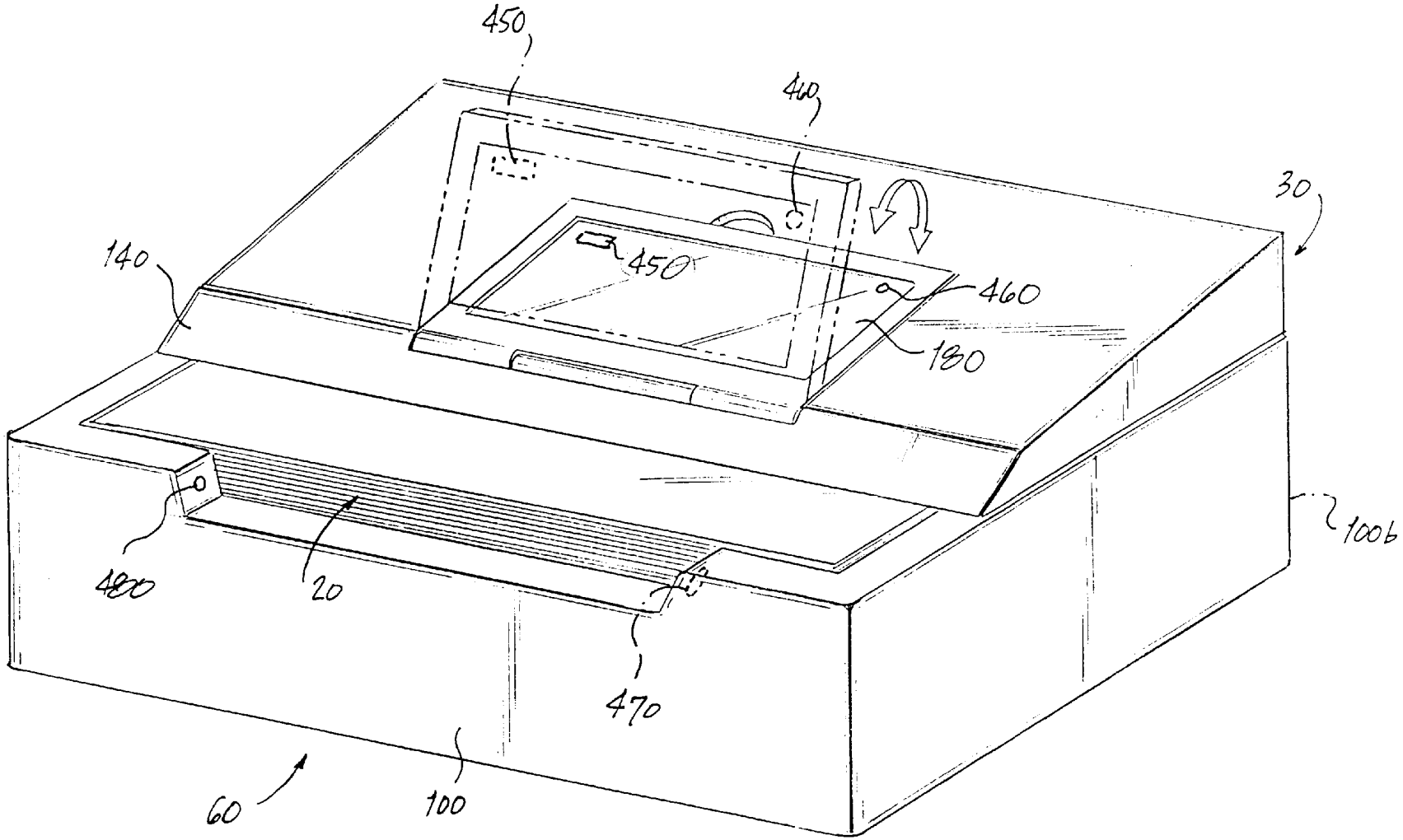
FIG. 8 is a perspective view of a third embodiment of the invention.

FIG. 8 shows an alternative embodiment which includes a low power indicator 450 for indicating when battery charging is required. The indicator 450 is connected to the rechargeable batteries 230 and may be incorporated into the display unit 180. Further, a photo voltaic cell 460 is connected to the display unit 180, causing the microprocessor 190 to remove power from the display unit 180 when the surrounding ambient light is switched off. The photo voltaic cell 460 reduces power consumption and further extends the life of the rechargeable batteries 230. If only a few sheets of notepaper 20 are printed on an average day, the combination of the photo voltaic cell 460 and the sleep mode for the microprocessor 190 keeps the battery 230 charged for an extended period of time.

In still another embodiment, as shown in FIG. 8, a second IR source 470 and IR sensor 480 are positioned in the front of shell 60 to form an external IR beam in front of the notepaper. IR sensor 480 is connected to the microprocessor 190 and senses when a user begins to remove a piece of notepaper 20 from the tray 70. The IR source 470 is driven by a very short pulse, typically one microsecond, at periodic intervals of time, such as every half second, independent of microprocessor 190.

In this embodiment, the internal IR source 270 is normally deactivated. Selecting a sheet of notepaper 20 sends a signal to the microprocessor 190, causing the microprocessor 190 to transition from the sleep-mode to the awake-mode, which will activate the internal IR source 270 to await movement of notepaper 20. Later, after a moment of post-printing inactivity or no paper motion, the microprocessor 190 deactivates the IR source 270 and transitions from the awake-mode to the sleep-mode.

Including the external source 470 and sensor 480 allows for further power savings. The amount of time required for the external IR source 470 to send a single pulse is a fraction of a second. Comparatively, the internal IR source 270 must operate continuously in the absence of the external IR source 470 and sensor 480. When only a few sheets of notepaper 20 are used on a daily basis, the power saved in this embodiment allows the invention to remain powered by a single charge of a rechargeable battery 230 for extremely long periods of time, on the order of months or longer.

The front face of the shell 60 may include a lip (not shown) to help separate the top sheet from the remaining sheets. The display unit 180 may be rotatably connected to the cover 30 so that the user can selectively control the angle of the display unit 180.

In the illustrated embodiments of the invention, a microprocessor is used to keep track of time information. Although less practical, mechanical means could be used instead. The invention also does not require any specific printing mechanism and, although thermal printing is preferred, other printing devices can be used, including mechanical printing devices. Of course, the device could be constructed so that notes are handwritten prior to removal of the paper from the tray. If it is necessary that the paper be pressed against the printed head, the biasing force could be applied to the printer device instead of the tray.

What is claimed is:

1. In combination, a pad of notepaper, a device for keeping track of time information, a printer mounted in operative engagement with the pad of notepaper;

means for sensing movement of the top piece of notepaper on said pad of notepaper as said top piece is removed from said pad; and means responsive to said sensing means for causing said printer to print time information on said top piece of notepaper while it is being removed from said pad.

2. The combination according to claim 1, wherein the printer is a thermal printer and each piece of paper includes a heat sensitive ink coating at least in the area which is engaged by the printer.

3. The combination according to claim 2, including a moveable tray for receiving the pad of notepaper, the tray biasing the notepaper against the printer.

4. The combination according to claim 2, including a display unit for displaying time information.

5. The combination according to claim 2, wherein the printer includes a print head having a multiplicity of individually actuable print elements, and wherein the time information is printed sequentially as the paper is removed from the pad.

6. The combination according to claim 1, including a container having a tray for holding the pad of paper and wherein the printer is mounted in a cover which is moveable with respect to the tray and overlies at least a portion of the paper when the cover is closed.

7. The combination according to claim 6, wherein the tray is moveable within the container, and further including means for biasing the tray toward the printer.

8. The combination according to claim 7, further including means for holding the tray in a position toward the bottom of the container so that a pad of paper can be placed on the tray; and means for releasing said holding means when the cover is closed.

9. The combination according to claim 2, including a container having a tray for holding the pad of paper and wherein the printer is mounted in a cover which is moveable with respect to the tray and overlies at least a portion of the paper when the cover is closed.

10. The combination according to claim 9, wherein the tray is moveable within the container, and further including means for biasing the tray toward the printer.

11. The combination according to claim 10, further including means for holding the tray in a position toward the bottom of the container so that a pad of paper can be placed on the tray; and means for releasing said holding means when the cover is closed.

12. Apparatus for printing time information on sheets of paper which are removed from the device comprising:

a container including a tray for supporting a pad of notepaper;

a cover connected to said container;

a printer mounted in said cover for printing time information on the uppermost piece of paper on the pad;

a microprocessor for keeping track of time information, said microprocessor being connected to said printer for enabling the printing of time information;

means for sensing movement of the top piece of notepaper on said pad of notepaper as said top piece is removed from said pad; and means responsive to said sensing means for causing said printer to print time information on said top piece of notepaper while it is being removed from said pad.

13. Apparatus according to claim 12, wherein the printer is a thermal printer.

14. Apparatus according to claim 12, wherein the tray is moveable within said container and further including means for urging the tray and printer toward each other.

15. Apparatus according to claim 14, further including means for holding the tray in a position near the bottom of the container so that a pad of paper can be placed on the tray, and means for releasing said holding means when the cover is closed.

16. Apparatus according to claim 12, wherein the printer includes a print head having a multiplicity of individually actuable print elements, and wherein the time information is printed sequentially as the paper is removed from the pad.

17. In combination, a device according to claim 13, and a pad of paper, the pad of paper being supported on said tray, and each piece of paper including an area coated with a heat responsive ink in proximity to said print head.

18. The combination according to claim 1, including:

means for producing an optical beam, means for periodically interrupting the beam at a rate dependent on the rate of movement of the paper as it is removed from the pad, and means for producing a signal dependent on the periodic rate of interruption of the beam, the printer being responsive to such signal to print said time information at a rate also dependent on the rate of movement of such paper.

19. The apparatus according to claim 12, including:

means for producing an optical beam, means for periodically interrupting the beam at a rate dependent on the rate of movement of the paper as it is removed from the pad, and means for producing a signal dependent on the periodic rate of interruption of the beam, the printer being responsive to such signal to print said time information at a rate also dependent on the rate of movement of such paper.

* * * * *

UNITED STATES PATENT AND TRADEMARK OFFICE

CERTIFICATE OF CORRECTION

PATENT NO. : 6,527,462 B2 
DATED : March 4, 2003
INVENTOR(S) : Arthur L. Arledge et al.

It is certified that error appears in the above-identified patent and that said Letters Patent is hereby corrected as shown below:

Title page,
Item [73], Assignee, delete "Brinwaves, Inc." and substitute -- Brainwaves, Inc. --

Signed and Sealed this

Twelfth Day of August, 2003

JAMES E. ROGAN
*Director of the United States Patent and Trademark Office*